US006146188A

United States Patent [19]

Snyder

[11] Patent Number: 6,146,188

[45] Date of Patent: Nov. 14, 2000

[54] HIGH DENSITY SHEAR CONNECTOR

[75] Inventor: Gene Larry Snyder, Bainbridge, N.Y.

[73] Assignee: Amphenol Corporation, Wallingford, Conn.

[21] Appl. No.: 09/432,118

[22] Filed: Nov. 2, 1999

[51] Int. Cl.[7] ..... H01R 13/58

[52] U.S. Cl. ..... 439/475; 439/474; 439/682; 439/923

[58] Field of Search ..... 439/474, 475, 439/923, 682

[56] References Cited

U.S. PATENT DOCUMENTS

| | | | |
|---|---|---|---|
| 2,951,421 | 9/1960 | Katzen . | |
| 3,786,410 | 1/1974 | Hazelhurst | 340/17 |
| 3,884,542 | 5/1975 | Flatt | 339/111 |
| 3,976,347 | 8/1976 | Cooke, Sr. et al. | 339/35 |
| 4,047,464 | 9/1977 | Fredriksson et al. | 89/1.811 |
| 4,099,038 | 7/1978 | Purdy | 200/61.08 |
| 4,136,919 | 1/1979 | Howard et al. | 339/75 P |
| 4,138,181 | 2/1979 | Hacker et al. . | |
| 4,490,002 | 12/1984 | Fowler . | |
| 4,522,458 | 6/1985 | Werth et al. . | |
| 4,863,397 | 9/1989 | Hatch, Jr. . | |
| 4,874,316 | 10/1989 | Kamon et al. . | |
| 5,346,406 | 9/1994 | Hoffman et al. | 439/474 |
| 5,385,480 | 1/1995 | Hoffman | 439/310 |
| 5,427,542 | 6/1995 | Gerow | 439/314 |
| 5,710,388 | 1/1998 | Hutchinson et al. . | |

*Primary Examiner*—Paula Bradley
*Assistant Examiner*—Truc Nguyen
*Attorney, Agent, or Firm*—Blank Rome Comisky & McCauley, LLP

[57] ABSTRACT

A shear connector includes a plug connector having front and rear insert portions on opposite sides of the shear plane that are held together by a shear bolt scored to shear at a predetermined force, and which is threaded directly into openings in the rear insert in such a way as to eliminate relative movement between the shear bolts and the rear insert during shearing. Pin contact sections extending rearwardly from the front insert are scored at the shear plane to shear at a predetermined force. By varying clearances between the pin contact sections and the sides of the openings of the rear insert into which the pin contact sections extend, groups of contacts can be made to shear at different times, thereby reducing the force required to shear each group without unduly weakening the contacts.

16 Claims, 4 Drawing Sheets

FIG. 6
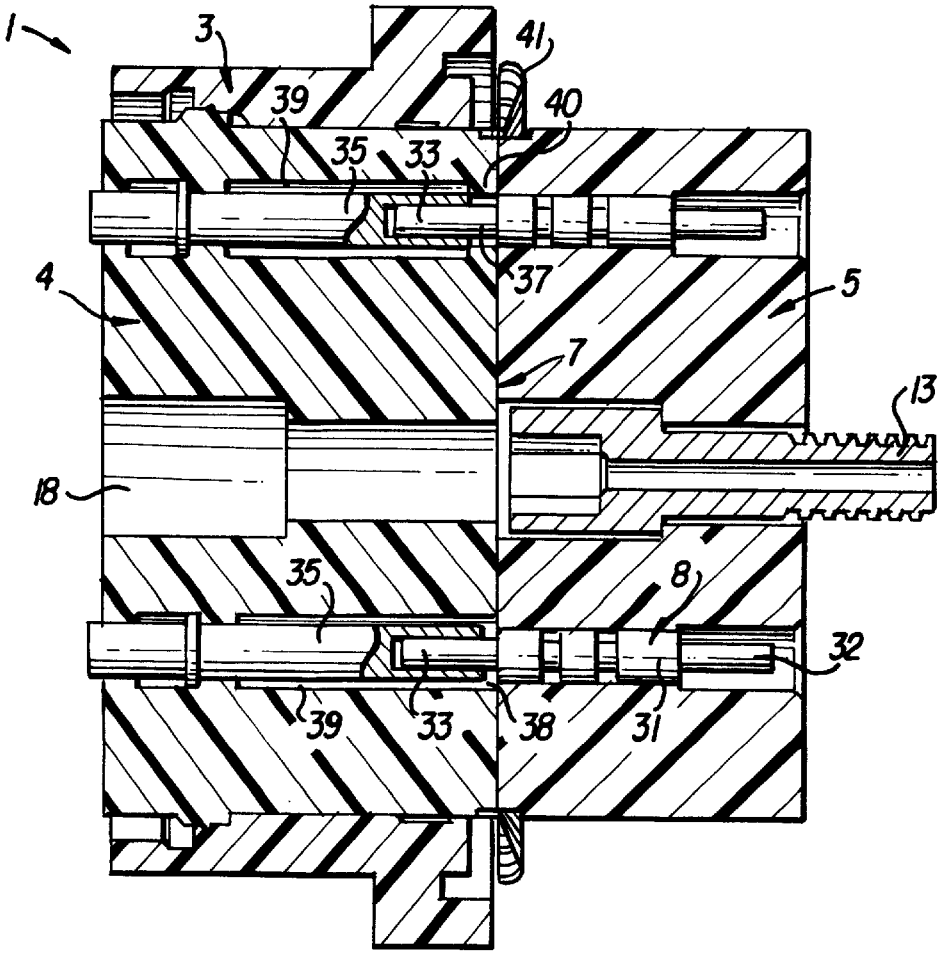
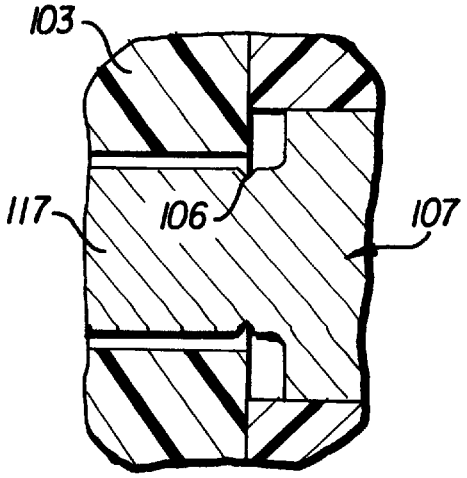
FIG. 8

HIGH DENSITY SHEAR CONNECTOR

BACKGROUND OF THE INVENTION

1. Field of the Invention

The present invention generally relates to the field of electrical connectors, and in particular to a 90° shear connector in which the contacts are sheared in groups at different times so as to minimize the shear force while maximizing individual contact strengths. The shear connector of the invention is especially suitable for use as an umbilical chord connector for a missile launching device.

2. Description of the Related Art

Electrical connection between a missile about to be launched and a corresponding launching device is conventionally provided by an umbilical chord that extends from the launching device to the missile. The umbilical chord is designed to break away from the missile when the electrical connection is no longer required and before the umbilical chord can interfere with lift off or cause damage to the launching device.

Break-away connectors have been in use for this purpose at least since the 1950's. The Atlas launch vehicle system used in the Mercury manned space program, for example, employed solenoids within the connector that were designed to unmate upon launching, while the Minuteman missile system used pyrotechnic (squib) charges to accomplish disconnection and break-away. Numerous other break-away arrangements have also been proposed or used, including arrangements involving shearing of the connector shell or coupling mechanism to allow the mating contacts to pull away from each other, as well as shear connectors having contacts designed to shear along a predetermined shear plane rather than to pull out of the mating connector during coupling.

As missile systems have become increasingly reliant upon computerized launching devices, the umbilical chord has had to carry greatly increased traffic, resulting in ever increasing contact densities for the umbilical chord connectors. As a result, problems such as shielding, environmental sealing, and prevention of contact shorting during break-away that were adequately addressed by the prior connector arrangements have become more acute, leading to the need for more sophisticated designs. Squib and electromechanical release arrangements that served well in the Atlas and Minuteman systems are difficult to implement in the high density connectors necessary for more modern tactical missile systems, while the early shear connector designs utilized contact arrangements entirely unsuitable for missile systems requiring high density data communications.

Two examples of prior shear connector arrangements of the type mentioned above are disclosed in U.S. Pat. Nos. 2,951,421 and 4,863,397. U.S. Pat. No. 2,951,421 describes a connector in which shearing is accomplished by using perforated tape contacts designed to tear apart during launch, while U.S. Pat. No. 4,863,397, designed for a gasoline pump rather than a missile launching device, describes a connector having notches in the shell designed to shear, followed by breaking apart of the contacts along a plane defined by the notches in the shell. Examples of non-shearing break-away connectors for various purposes are also found in U.S. Pat. Nos. 4,138,181, 4,490,002, 4,522,458, and 4,874,316.

Neither of the shear connectors disclosed in U.S. Pat. Nos. 2,951,421 or 4,863,397 is suitable for use in more contemporary missile launch systems. Aside from the problems of lack of adequate shielding and the non-standard nature of the contacts disclosed in U.S. Pat. No. 2,951,421, neither of the shear connectors disclosed in these patents provide sufficient control of the shear forces to ensure a clean break at exactly the right moment during launch. The connector of U.S. Pat. No. 2,951,421 was basically designed for low density power connections, while the gasoline pump connector of U.S. Pat. No. 4,863,397 not only provides a relatively low contact density, but also utilizes a spring to pull the connectors apart following shearing of the connector shell.

In order to better control the shear forces by eliminating reliance on shearing of the connector shell as in U.S. Pat. No. 4,863,397, or reliance solely on perforations in the contacts as in U.S. Pat. No. 2,951,421, and to allow for connector sealing, grounding, and shielding arrangements not required in U.S. Pat. Nos. 4,863,397 and 2,951,421, an improved shear connector corresponding to the one illustrated in FIGS. 7–9 was proposed as part of the program to replace the current RIM-7 Sea Sparrow Missile used by the U.S. and NATO navies. While FIGS. 7–9 are included as background for the present invention, it is to be understood that these figures do not necessary depict "prior art" since the present inventor was also primarily responsible for development of the connector illustrated in FIGS. 7–9, which was never placed into production.

In the connector of FIGS. 7–9, the need for shearing of the plug connector shell 100 is eliminated by terminating the plug connector shell short of the shear plane 101 and by providing a two part plug connector insert 102,103 within the connector shell, the mating or front insert 102 and the rear insert 103 of the connector insert being held together by shear pins 104 integrally molded with front insert 102, inserted into openings 105 in rear insert 103, and secured by an adhesive. To ensure a clean break at the shear plane 101 between the front and rear inserts following shearing of pins 104, the proposed connector also features scoring or notching 106 of the plug connector contacts 107, as shown in FIG. 8, and multiple ramps 108 and corresponding cavities or indents 109 to prevent relative vertical movement of the contacts and possible shorting of missile circuits following shearing.

This design further included various features designed to ensure ground continuity between the plug and receptacle, electromagnetic interference (EMI) shielding, environmental sealing, and ease of initial interconnection of the plug and receptacle, such as a ground strap between the plug connector shell 100 and receptacle connector shell 110. As illustrated in FIG. 9, for example, the plug and receptacle are provided with an O-ring seal 111, a jack screw 112 to secure the front portion 102 of the connector insert to the receptacle by means of a threaded sleeve 113 molded into the receptacle insert 114, and pins 115 extending from the receptacle insert to orient or polarize the plug and receptacle to ensure proper mating of plug connector contacts 107 with receptacle connector contacts 116. Finally, to facilitate assembly, plug connector contacts 107 are divided into two sections to facilitate assembly of the front and rear inserts 102,103, including scored double-ended contact pins 117 molded into the front insert portion 102 and rear contact sleeves 118 fitted into openings 119 in the rear insert portion 103.

While many of the features of the connector illustrated in FIGS. 7–9 have been incorporated into the shear connector of the present invention, preliminary tests on the connector illustrated in FIGS. 7–9 resulted in failure of the connector to shear cleanly at the required minimum force. The problem turned out to lie in the inability to adequately control shearing of the shear pins 104, and the excessive force required to shear all of the contacts 107 at the same time without unduly weakening the contacts.

As a result, a new structure was needed to connect the front insert portion to the rear insert portion in such a way as to enable shearing or breakage of the connection at a predetermined force, and to reduce the amount of force necessary to shear the contacts while providing contacts of sufficient strength. The present invention addresses both of these problems, while still including the features of plug-to-receptacle grounding, EMI protections, O-ring sealing, and ease of interconnection offered by the design illustrated in FIGS. 7–9.

SUMMARY OF THE INVENTION

It is accordingly a first objective of the invention to overcome the problems of the shear connector illustrated in FIGS. 7–9, and of other prior shear connectors, by providing an improved structure for attaching a front plug connector insert to a rear plug connector insert.

It is a further objective of the invention to overcome the problems of prior shear connectors, including the shear connector illustrated in FIGS. 7–9, by providing a structure for reducing the force necessary to shear the contacts following shearing of the front and rear insert connection structure without unduly weakening the contacts.

It is a still further objective of the invention to provide a shear connector having a higher contact density than a conventional shear connector, and that also includes sealing capabilities, shell grounding, and EMI shielding.

These objectives are achieved, in accordance with the principles of a preferred embodiment of the invention, by providing a shear connector in which the front and rear insert portions on opposite sides of the shear plane are held together by a shear bolt scored to shear at a predetermined force, and which is threaded directly into openings in the rear insert in such a way as to eliminate relative movement between the shear bolts and the rear insert during shearing.

The objectives of the invention are further achieved by providing a shear connector having improved shear bolts and in which the shear bolts and pin contacts are arranged to break away according to a predetermined sequence, rather than all at once, in order to produce a total shear force that is in agreement with mandated requirements.

More particularly, the shear connector of the preferred embodiment of the invention is made up of a plug and a receptacle designed to separate along a vertical shear plane extending through the plug when the plug is mounted so that the plug and receptacle mate along a horizontal axis, with the separation being achieved by the shearing of pin contacts and shear bolts. The plug includes a shell, an insert assembly made up of a front insert and a rear insert, and a ground strap, with the front insert and the rear insert being held together by an upper shear bolt and a lower shear bolt.

Molded into the front insert are double-ended pin contacts and threaded sleeves for receiving the shear bolts. Each shear bolt includes a first threaded section which is threaded into the threaded sleeve, and a second threaded section which provides a slight interference fit with the insert and which cuts its own thread into the insert cavity so as to eliminate any vertical movement of the shear bolt that may occur during the shearing operation. Between the two threaded sections are a notch designed to cause shearing of the shear bolt upon application of the predetermined force.

The rear portion of the contacts has a notch machined into the periphery and positioned on the shear plane to cause shearing of the contacts when a predetermined force is applied thereto. The force is applied following shearing of the upper and lower shear bolts by movement of the rear insert in a direction which causes the wall of a recess in the rear insert to engage the shear pin and transmit the shear force thereto. The clearance between the rear insert and the scored contact pin determines the timing of the shearing, with the clearance being varied to cause groups of sequence the shearing, i.e., to cause groups of contacts to shear at different times, thereby decreasing the total force required to shear the contacts at any one time.. Preferably, shearing of the contacts takes place in four groups at different time frames. The staggered shearing of the contact groups allows for stronger individual contacts and eliminates the excessively high total shear force that will occur if all contacts shear at once.

The receptacle of the preferred shear connector includes a shell and an insert assembly included molded-in socket contacts, a threaded sleeve, and guide pins. The mated plug and receptacle are held together by a jackscrew extending through the front and rear plug inserts, and a threaded sleeve molded into the receptacle insert assembly, the jack screw being positioned on the receptacle side of the shear plane so that it does not affect the shearing operation. Assembly of the plug to the receptacle thus involves the simple steps of inserting the plug front insert into the receptacle and tightening the jack screw to secure the plug to the receptacle.

Ground continuity and EMI shielding is ensured in the preferred shear connector by a ground strap that extends around the front insert and that is sandwiched between the receptacle and plug connector shells upon mating. In addition, an O-ring is positioned in the receptacle shell so as to be radially compressed between the receptacle shell and the front insert upon insertion of the front insert into the receptacle shell to prevent passage of moisture and other environmental contaminants through the interior of the mated connectors.

Finally, as in the shear connector system illustrated in FIGS. 7–9, molded into the front insert are a plurality of cavities that match a corresponding number of ramp-shaped projections molded into the rear insert. This ramp feature provides horizontal movement at the time of shear to prevent sheared contacts from shorting with adjacent sheared contacts. The ramp and cavity intermate is designed to prevent horizontal movement until the contacts and shear bolts have completely sheared.

The shear connector of the preferred embodiment is particularly suitable for launching missiles of the type used in naval weapons systems, although the invention is not intended to be limited to a particular missile launch systems. In addition, the invention may have applicability to applications other than missile launch systems.

BRIEF DESCRIPTION OF THE DRAWINGS

FIG. 6 is a cross-sectional side view taken along a plane different from that of the cross-section of FIGS. 1, 2, and 5, in order to show two scored contacts with different clearances between the contacts and a rear insert so as to cause the contacts to shear at different times.

FIG. 8 is a cross-sectional side view of a receptacle connector corresponding to the prototype plug connector of FIG. 7.

DETAILED DESCRIPTION OF THE PREFERRED EMBODIMENTS

Figure 2:
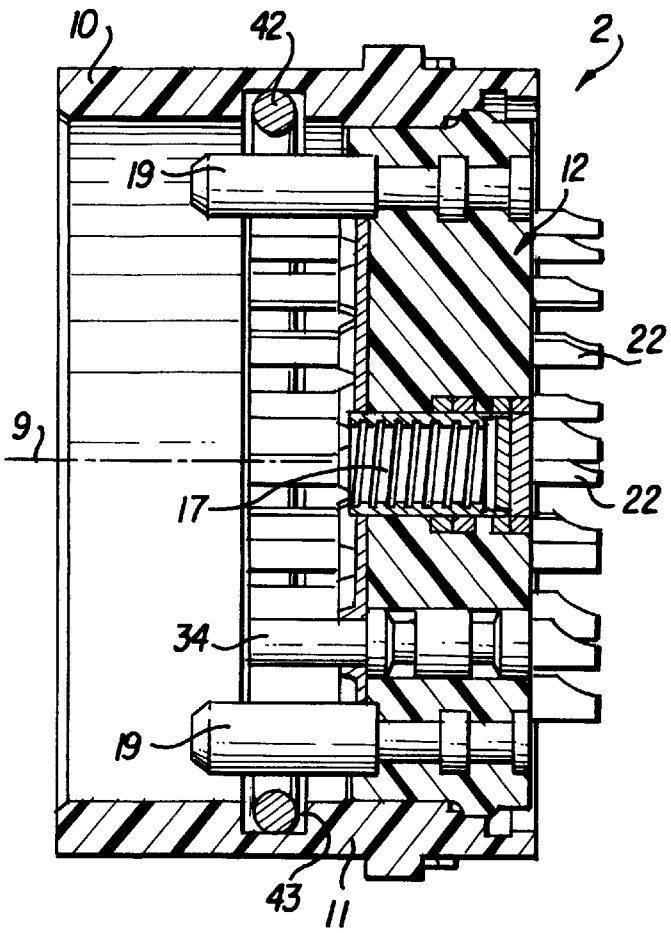
FIG. 2 is a cross-sectional side view of a receptacle half of a 90° shear connector system arranged in accordance with the principles of the preferred embodiment of the invention.
Figure 1:
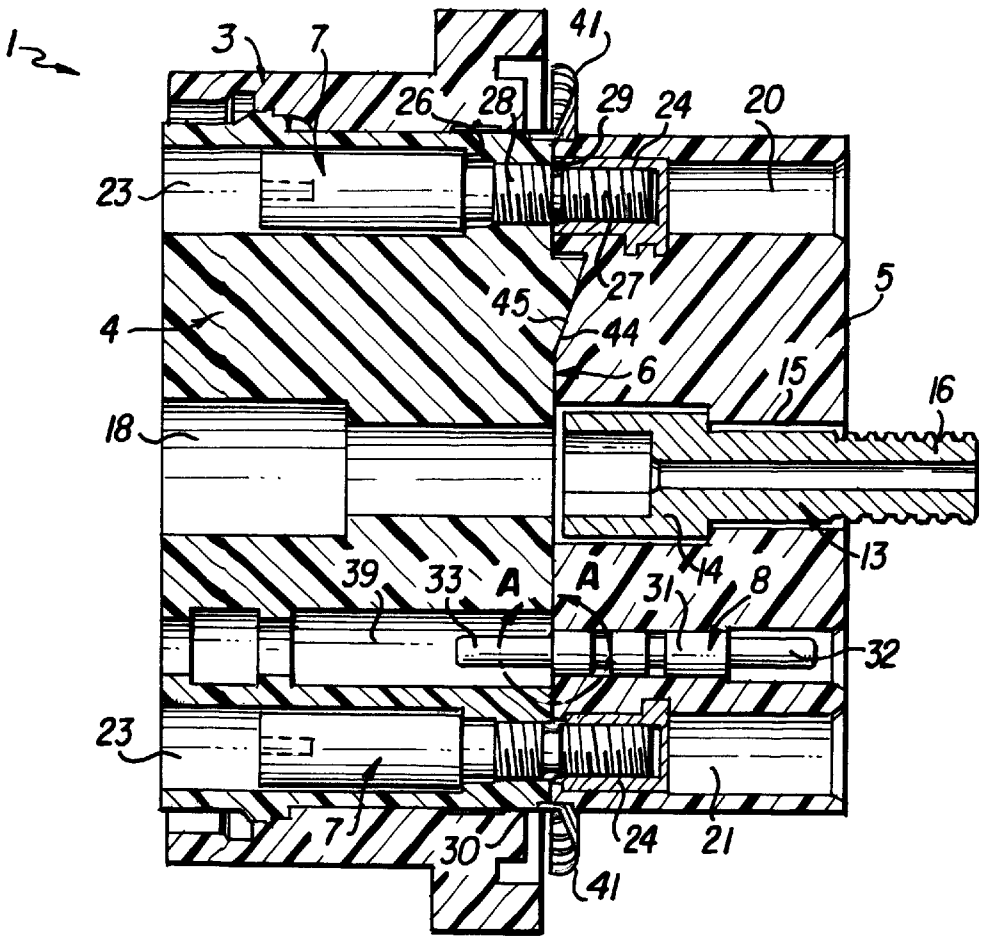
FIG. 1 is a cross-sectional side view of the plug connector half of a 90° shear connector system arranged in accordance with the principles of a preferred embodiment of the invention.
Figure 5:
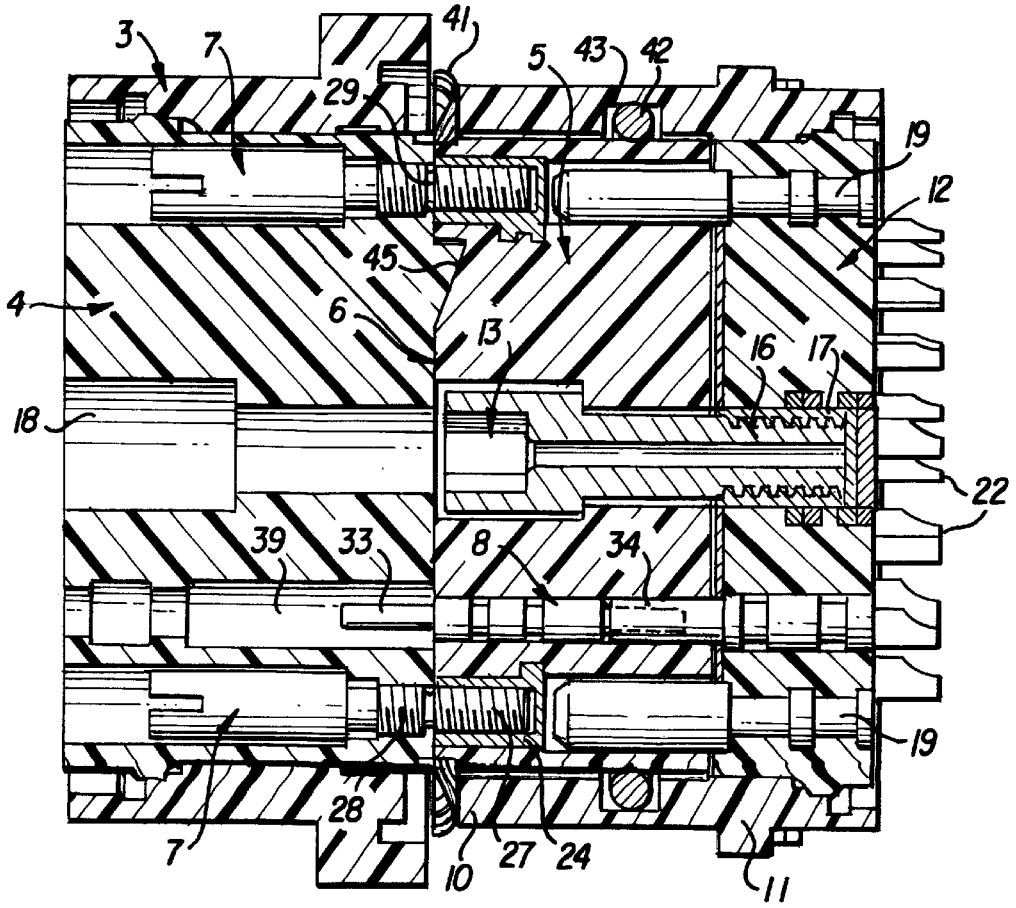
FIG. 5 is a cross-sectional side view corresponding to the side view of FIGS. 1 and 2 showing the plug and receptacle portions of the preferred connector following mating.

As illustrated in FIGS. 1, 2, and 5, a shear connector constructed in accordance with the principles of a preferred embodiment of the invention includes a plug 1 and a receptacle 2. As in the connector illustrated in FIGS. 7–9, plug 1 includes a shell 3 and an insert made up of a rear section 4 and a front section 5 arranged to face each other at a planar interface 6, the front section 5 extending forwardly of the planar interface.

Figure 9:
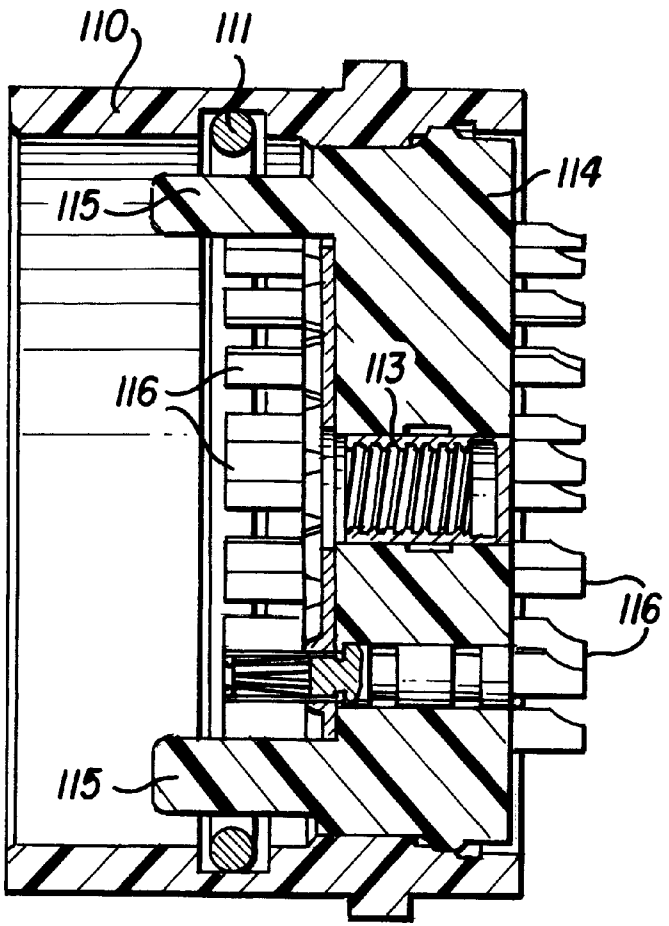
FIG. 9 is a enlarged cross-sectional view showing details of a contact used in the previously proposed experimental shear connector system of FIGS. 7 and 8.
Figure 7:
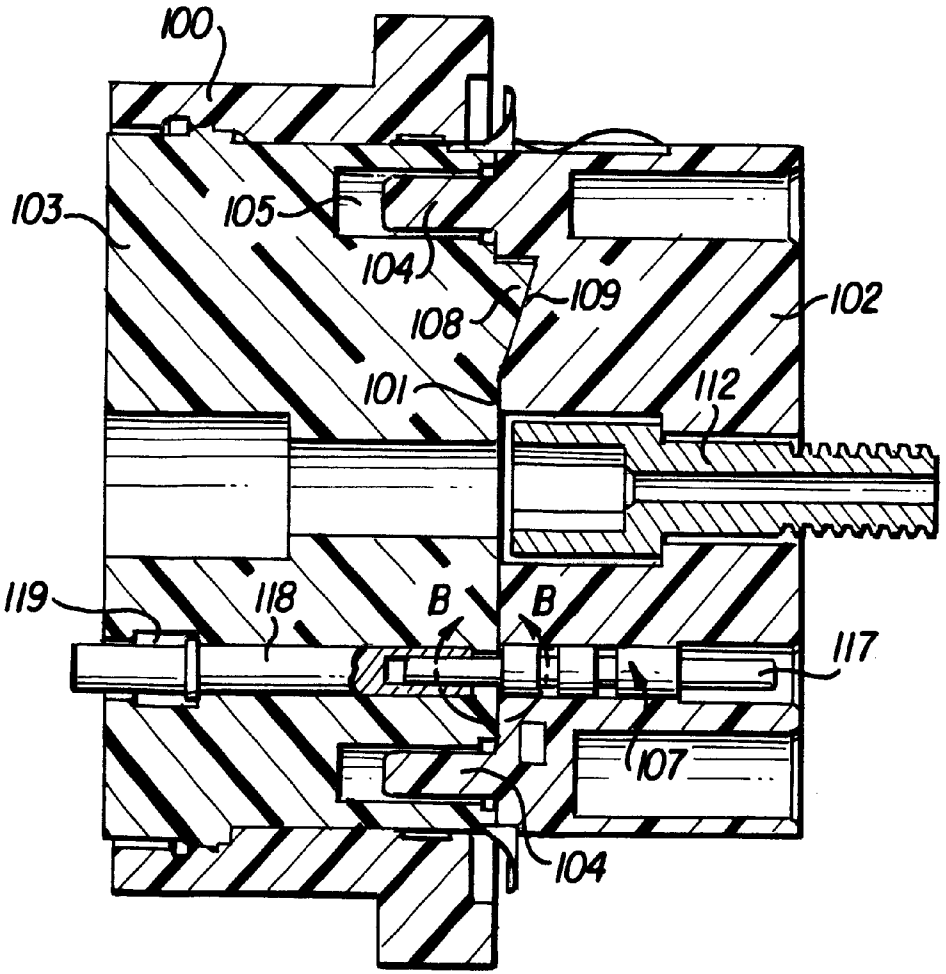
FIG. 7 is a cross-sectional side view of an experimental prototype version of the preferred plug connector of FIGS. 1–6 that lacks shear bolts, sequential shearing, and various features of the preferred embodiment.

However, in contrast to the connector of FIGS. 7–9, in the shear connector of the preferred embodiment, rear and front insert sections 4 and 5 are held together by shear bolts 7. In addition, as will be explained in more detail below in connection with FIG. 7, front contact sections 8 are arranged to shear at different times so as to decrease the amount of force necessary to achieve shearing without reducing the strength of the individual contacts. It will be appreciated that plug I and receptacle 2 are generally cylindrical in configuration and thus the three-dimensional configurations of the plug and receptacle should be apparent based solely on the illustrated cross-sections.

Plug 1 is arranged to be inserted into receptacle 2 along a horizontal axis 9 that is perpendicular to the planar interface 6. Because the front and rear insert sections are held together only by shear bolts 7 with shell 3 terminating short of the planar interface, planar interface 6 forms a shear plane along which the front contact sections 8 as well as the shear bolts 7 are sheared following application of a shear force, for example, during launching of a missile.

Receptacle 2 includes a shell made up of a mating section 10 arranged to fit over the front section 5 of the plug insert and a rear section 11 arranged to hold an insert 12. Upon mating, the plug and receptacle are held together by a jack screw 13 having an enlarged diameter rear section 14 which is captured in an opening 15 in the front insert 5 below the shear plane and a threaded front section 16 which is threaded into a sleeve 17 molded into the receptacle insert 12. An opening 18 in the rear insert 4 affords access to the jackscrew 13 so as to enable the jackscrew to be turned upon insertion of the plug 1 into the receptacle 2 following alignment of molded-in stainless steel guide pins 19 with corresponding openings 20 and 21 in the front insert 5 (in contrast to the molded plastic guide pins of the shear connector illustrated in FIGS. 7–9), and also following insertion of the guide pins into the corresponding openings together with insertion of front contact sections 8 into receptacle contacts 22. Those skilled in the art will appreciate that, because of its location, jackscrew 13 is not a factor in the shearing operation, except to the extent that jackscrew 13 prevents separation of the front insert 5 from the receptacle 2 as rear insert 4 separates from the front insert 5, and that the purpose of jackscrew 13 is solely to latch the plug and receptacle together prior to shearing, the front insert remaining attached to the receptacle following shearing.

Figure 3:
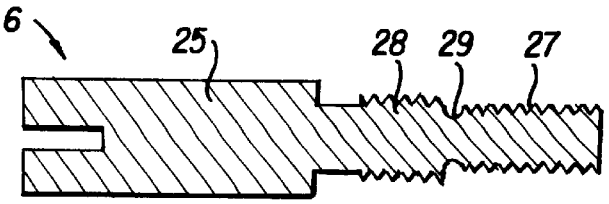
FIG. 3 is a cross-sectional side view of a shear bolt for use in the connector of FIGS. 1 and 2.

Shear bolts 7 are used to secure the front and rear inserts 3 and 4 to each other. This is accomplished by inserting bolts 7 into openings 23 and threading them into sleeves 24, which are preferably molded into front insert 5. As shown in FIG. 3, each shear bolt 7 includes a main body 25 arranged to engage a shoulder 26 in openings 23, a first threaded section 27, and a second threaded section 28 separated by a circumferential groove 29. The first threaded section 27 of each shear bolt 7 is threaded into the corresponding internally threaded sleeve 24 to provide a mechanical means for holding the insert halves together. In addition, the second threaded section 28 preferably provides a slight interference fit with a reduced diameter front section 30 of openings 23, the threads on the second threaded section 28 being arranged to self tap the opening so as to eliminate any vertical movement of the shear bolt that may occur during the shearing operation. Circumferential groove 29 is positioned on the shear plane 6 and is designed to meet required shear forces.

Figure 4:
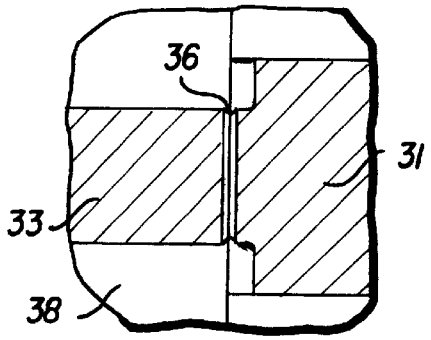
FIG. 4 is a cross-sectional side view showing details of a scored contact for use in the connector of FIGS. 1 and 2.

Front contact sections 8 are in the form of double-ended pin contacts having a main body 31 molded into the front insert 5, and reduced diameter pin sections 32 and 33 extending axially from the main body. Pin sections 32 extend forwardly to engage corresponding sleeve sections 34 of receptacle contacts 22, while pin sections 33 extend rearwardly to engage contact sleeves 35 (shown only in FIG. 6) positioned in the rear insert 4. As illustrated in FIG. 4, the pin section 33 of each contacts 8 includes a circumferential groove or notch 36 machined into its periphery, the notch being positioned on the shear plane and designed to facilitate shearing of the contact at a predetermined shear force.

Sequential shearing of the front contact sections 8 following shearing of the shear bolts 7 is accomplished by varying respective clearances 37 and 38 between the rearwardly extending pin sections 33 of contacts 8 and the edges of rear insert 4. The clearances can be varied either by varying the size of openings 39 into which the rear contact sleeves are fitted or, as illustrated, by including in openings 39 an inwardly extending shoulder 40. The differences in timing at which the groups are sheared results from the different amount of time it takes, during movement of the rear insert following shearing of the shear bolts 7, for the walls of the openings 39 to reach the contact sections 33 and thereby transmit the shear force from the rear insert to the contacts.

Although only two different clearances are illustrated, and the number of clearances may be varied depending on the desired shear force, a practical implementation of the shear connector of the invention includes four groups of contacts, each group being provided with a different clearance. The resulting shear force on each individual group of contacts is, as will be appreciated by those skilled in the art, the total shear force divided by the number of groups of contacts. In the case of four groups, the total shear force being applied to the contacts at any given instant is the total shear force divided by four, which means that the depth of the notch 36 can be reduced by a corresponding factor in comparison with the connector illustrated in FIGS. 7–9.

Ground continuity between the shell 3 of plug 1 and front mating section 10 of receptacle 2, and therefore EMI shielding, is ensured by a ground strap 41 that extends around the front insert 5 and that engages front mating section 10 upon mating of the plug and receptacle in order to electrically connect the plug and receptacle shells, as shown in FIG. 5. In addition, an O-ring 42 is preferably situated in a groove 43 of the receptacle shell to provide environmental sealing of the mated plug and receptacle.

Finally, as in the shear connector illustrated in FIGS. 7–9, molded into the front insert 5 of plug 1 are three cavities 44 that match three ramp-shaped projections 45 molded into the rear insert 4. This ramp feature provides horizontal movement at the time of shear to prevent sheared contacts from contacting adjacent sheared contacts and therefore possibly shorting electrical circuits in the launching device or missile to which the respective contacts are connected. The ramp and cavity feature is designed to prevent horizontal movement until the contacts and shear bolts have completely sheared.

Having thus described a preferred embodiment of the invention and variations of the preferred embodiment in sufficient detail to enable those skilled in the art to make and use the invention, it will nevertheless be appreciated by those skilled in the art that the illustrated shear connector may be further varied or modified by those skilled in the art. For example, the jackscrew 13 may be replaced by a coupling sleeve or by any other suitable mechanism for coupling the front insert 5 to the receptacle. Alternatively, shear bolts 8 may be fixed in rear insert 4 by adhesives or mechanical means other than the illustrated interference fit.

Each of these variations and modifications, including those not specifically mentioned herein, is intended to be included within the scope of the invention, and thus the description of the invention and the illustrations thereof are not to be taken as limiting, but rather it is intended that the invention should be defined solely by the appended claims.

What is claimed is:

1. A shear connector arrangement, comprising:

a plug connector having a shell, a rear insert positioned in the shell, a front insert connected to the rear insert by at least one shear bolt, and a plurality of contacts positioned in said front insert, wherein said front insert and rear insert include respective planar facing surfaces that form a shear plane and said shell terminates at said shear plane to permit shearing of said front insert from said rear insert without shearing of said shell, wherein said shear bolt is arranged to shear upon said shear bolt experiencing a predetermined shear force, wherein said contacts are also arranged to shear upon experiencing a predetermined shear force, and wherein said plurality of contacts extend into openings in said rear insert, respective clearances between walls of said openings and said plurality of contacts being varied to vary a timing of said rear insert engaging said contacts to cause shearing of said contacts to occur following shearing of said shear bolt;

a receptacle connector having a shell, an insert, and a plurality of contacts arranged to mate with said contacts of the plug connector, wherein said receptacle connector is arranged to receive said front insert of said plug connector and to be secured thereto to establish an electrical connection between said plug connector contacts and said receptacle connector contacts prior to shearing of said plug connector contacts.

2. A shear connector arrangement as claimed in claim 1, wherein said shear bolt includes circumferential grooves situated in the shear plane, said grooves determining the force at which shearing of said bolt occurs.

3. A shear connector arrangement as claimed in claim 2, wherein said shear bolt further includes a main body positioned in an opening in the rear insert, and a first threaded section arranged to be threaded into a sleeve in the front insert.

4. A shear connector arrangement as claimed in claim 3, further comprising a second threaded section forming an interference fit with the opening in the rear insert, said second threaded section being threaded directly into said rear insert to prevent relative movement between the shear bolt and the rear insert, said circumferential groove separating said two threaded sections.

5. A shear connector arrangement as claimed in claim 1, wherein said plurality of contacts each includes a circumferential groove located in said shear plane to control a shearing force at which an individual contact will shear.

6. A shear connector arrangement as claimed in claim 1, wherein said front insert is arranged to be secured to said receptacle by a jackscrew extending through said front insert and captured between said front and rear inserts, and an internally threaded sleeve positioned in said receptacle connector and into which said jackscrew is arranged to be threaded.

7. A shear connector arrangement as claimed in claim 1, further comprising positioning pins molded into an insert positioned in said receptacle connector.

8. A shear connector arrangement as claimed n claim 1, further comprising a ground strap positioned between said shell of said plug connector and a shell of said receptacle connector upon mating of said plug connector to said receptacle connector.

9. A shear connector arrangement as claimed in claim 1, further comprising an O-ring positioned in said receptacle connector and arranged to be sandwiched between a shell of said receptacle connector and said front insert upon mating of said plug connector to said receptacle connector.

10. A shear connector arrangement, comprising:

a plug connector having a shell, a rear insert positioned in the shell, a front insert connected to the rear insert by at least one shear bolt, and a plurality of contacts positioned in said front insert, wherein said front insert and rear insert include respective planar facing surfaces that form a shear plane and said shell terminates at said shear plane to permit shearing of said front insert from said rear insert without shearing of said shell, wherein said shear bolt is arranged to shear upon said shear bolt experiencing a predetermined shear force, and wherein said contacts are also arranged to shear upon experiencing a predetermined shear force;

a receptacle connector having a shell, an insert, and a plurality of contacts arranged to mate with said contacts of the plug connector, wherein said receptacle connector is arranged to receive said front insert of said plug connector and to be secured thereto to establish an electrical connection between said plug connector contacts and said receptacle connector contacts prior to shearing of said plug connector contacts, wherein said shear bolt includes a circumferential groove situated in the shear plane, said groove determining the force at which shearing of said bolt occurs, and wherein said shear bolt further includes a main body positioned in an opening in the rear insert, and a first threaded section arranged to be threaded into a sleeve in the front insert.

11. A shear connector arrangement as claimed in claim 10, further comprising a second threaded section forming an interference fit with the opening in the rear insert, said second threaded section being threaded directly into said rear insert to prevent relative movement between the shear bolt and the rear insert, said circumferential groove separating said two threaded sections.

12. A shear connector arrangement as claimed in claim 10, wherein said plurality of contacts each includes a circumferential groove located in said shear plane to control a shearing force at which an individual contact will shear.

13. A shear connector arrangement as claimed in claim 10, wherein said front insert is arranged to be secured to said receptacle by a jackscrew extending through said front insert and captured between said front and rear inserts, and an internally threaded sleeve positioned in said receptacle connector and into which said jackscrew is arranged to be threaded.

14. A shear connector arrangement as claimed in claim 10, further comprising positioning pins molded into an insert positioned in said receptacle connector.

15. A shear connector arrangement as claimed in claim 10, further comprising a ground strap positioned between said shell of said plug connector and a shell of said receptacle connector upon mating of said plug connector to said receptacle connector.

16. A shear connector arrangement as claimed in claim 10, further comprising an O-ring positioned in said receptacle connector and arranged to be sandwiched between a shell of said receptacle connector and said front insert upon mating of said plug connector to said receptacle connector.

* * * * *